United States Patent [19]

Miyamoto

[11] 4,369,424

[45] Jan. 18, 1983

[54] SLIDE RHEOSTAT

[75] Inventor: Takahiro Miyamoto, Miyagi, Japan

[73] Assignee: Alps Electric Co. Ltd., Tokyo, Japan

[21] Appl. No.: 284,090

[22] Filed: Jul. 16, 1981

[30] Foreign Application Priority Data

Jul. 18, 1980 [JP] Japan ..... 55-101513

[51] Int. Cl.[3] ..... H01C 10/30

[52] U.S. Cl. ..... 338/161; 338/176; 338/184; 338/199

[58] Field of Search ..... 338/161, 160, 176, 183, 338/165, 184, 164, 199, 188

[56] References Cited

U.S. PATENT DOCUMENTS

| | | | |
|---|---|---|---|
| 3,566,330 | 2/1971 | Ichikawa et al. | 338/183 X |
| 3,609,623 | 9/1971 | Zdanys, Jr. | 338/183 |
| 3,676,827 | 7/1972 | Nomura | 338/183 |
| 3,966,550 | 12/1976 | Yano et al. | 338/183 |
| 4,101,864 | 7/1978 | Van Benthuysen | 338/183 |

*Primary Examiner*—C. L. Albritton

*Attorney, Agent, or Firm*—Guy W. Shoup; Gerard F. Dunne

[57] ABSTRACT

A slide rheostat comprising a metal case whose lower surface is open and which is formed with a longitudinal slot in its upper surface portion, an insulating frame which includes an upper surface portion sufficiently larger in width and length than the slot and a pair of elastic engaging pieces slightly inclining outwardly of its end surface portions, an insulating substrate on which an elongate resistor and an elongate collector are formed, a slider which includes elastic metal members adapted to slide in contact with the resistor and the collector respectively, and an insulating slider carrier to which the slider is fastened. When the frame, the slider carrier and the insulating substrate are assembled with the case, the resistor and the collector are shielded from the slot of the case by the upper surface portion of the frame. The slide rheostat is installed on a mounting plate by snapping the elastic engaging pieces of the frame into a hole provided in the mounting plate.

3 Claims, 4 Drawing Figures

SLIDE RHEOSTAT

The present invention relates to a slide rheostat.

Slide rheostats typically have a slot formed in their casing or housing for receiving a projecting control lever of a slide member, and a simple electrically-insulating and dust-proof structure is desired for such slide rheostats. It is also desirable to design the rheostat so that it can be simply installed on a mounting plate.

It is accordingly an object of the present invention to provide a slide rheostat in which portions to be energized are shielded from the guide slot for the control lever and which may be installed easily on a mounting plate by the snap-in method.

According to one aspect of performance of the present invention, there is provided a slide rheostat comprising a case which is made of a metal material, whose lower surface is open and which has a slot formed lengthwise in its upper surface portion. A frame which is made of a molded insulating material is provided with an upper surface portion sufficiently larger in width and length than said slot of said case, and has a side surface portion, a pair of end surface portions and a pair of resilient engaging pieces slightly inclining outwardly of said end surface portions. An insulating substrate carries an elongate resistor and an elongate collector, and a slider carrier made of a molded insulating material carries a slider adapted to slide in contact with said elongate resistor and said elongate collector. The elongate resistor and elongate collector are covered by said upper surface portion of said frame when said frame, said slider carrier and said insulating substrate are assembled with said case.

Figure 1:
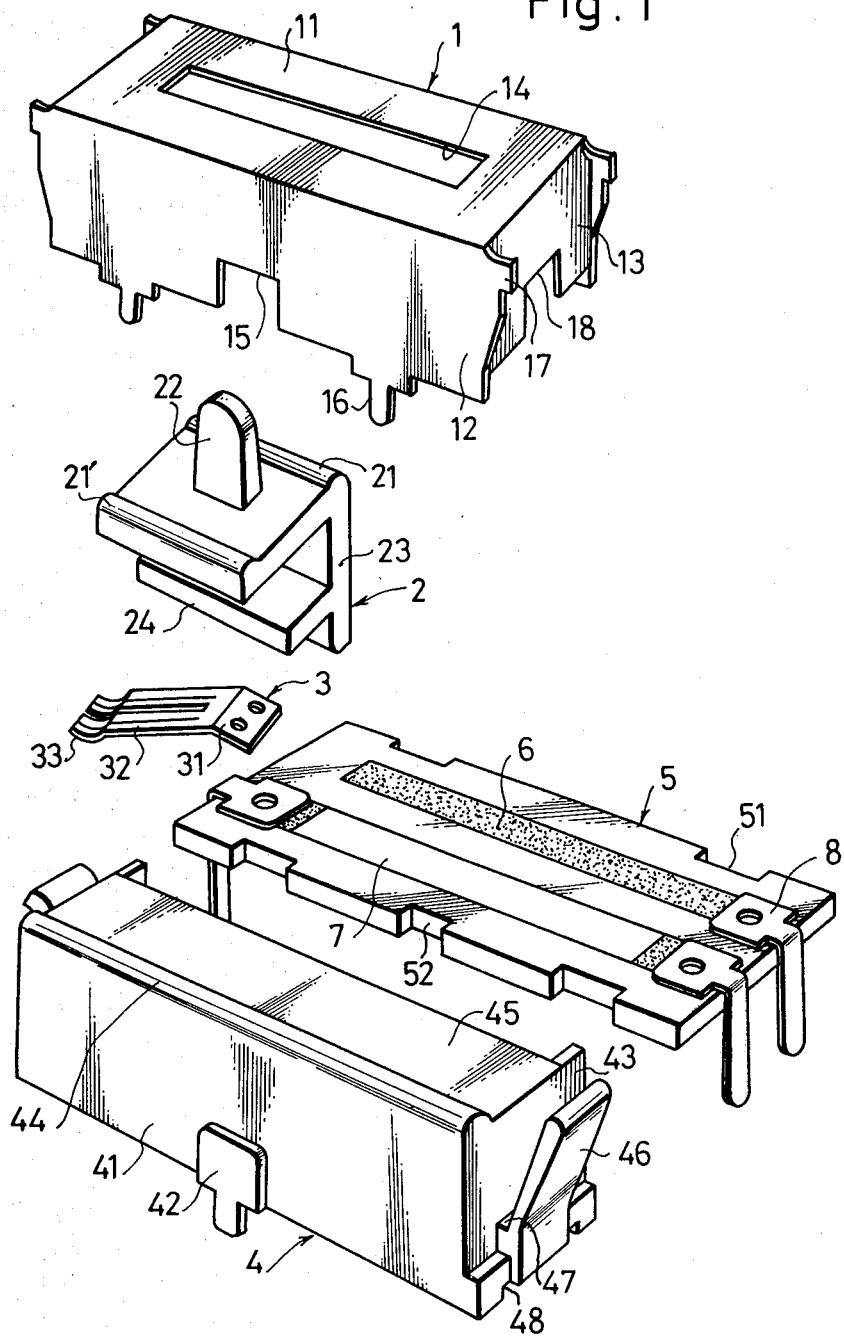
Figure 2:
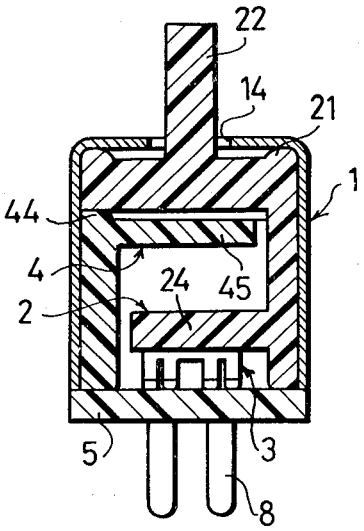
Figure 3A:
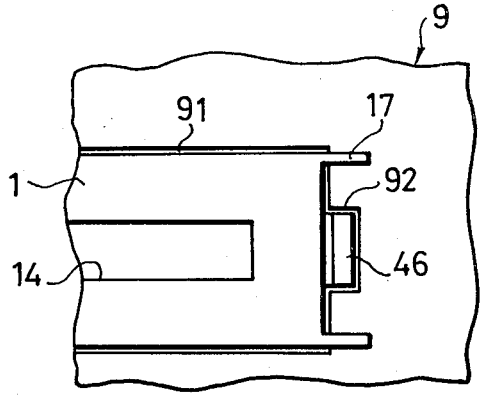
Figure 3B:
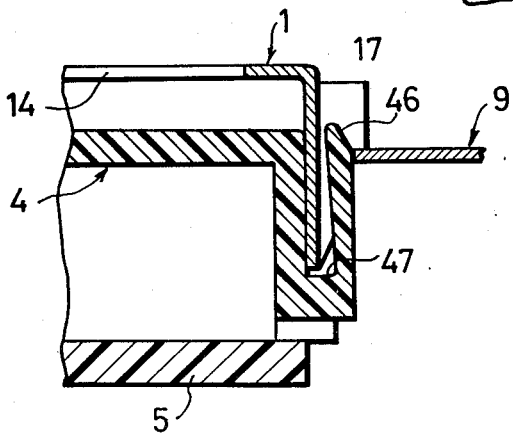

Hereunder an embodiment of the present invention will be described in detail with reference to the accompanying drawings, in which:

FIG. 1 is an exploded perspective view showing an embodiment of the present invention, FIG. 2 is a sectional side view of the embodiment, and FIGS. 3(A) and 3(B) are a fragmentary plan view and a fragmentary sectional front view of the rheostat of the present invention installed on a mounting plate, respectively.

Numeral 1 designates a substantially box-shaped case made of a metal material, which is provided with an upper surface portion 11, a pair of side surface portions 12 and a pair of end surface portions 13 and whose lower surface is open. A slot 14 for guiding the lever 22 of a slider carrier 2 to be described below is formed in the upper surface portion 11. An indent 15, mounting legs 16 and engaging lugs 17 are formed in each of the side surface portions 12. An indent 18 is formed in each of the end surface portions 13.

The slider carrier 2 is made of molded insulating material. It is provided with the lever 22, two guiding ribs 21 and 21' formed respectively along its side portions, a supporting leg 23 extending downwards from rib 21, and a mounting portion 24 extending from an intermediate part of the supporting leg 23 orthogonally thereto. Numeral 3 indicates a slider which is made of an a resilient metal material. It includes a mounting portion 31 and a plurality of contactors 32 with contact portions 33, and it is secured to the mounting portion 24 of the slider carrier 2.

A frame 4 is made of a molded insulating material. It is unitarily provided with a side surface portion 41 having an engaging piece 42, a pair of end surface portions 43, an upper surface portion 45 having a raised shoulder 44, and a pair of elastic engaging pieces 46 slightly inclining outwardly of the end surface portions 43. Notches 48 serve to lead out terminals 8 to be described later.

An insulating substrate 5 has recesses 51 for receiving the mounting legs 16 of the case 1, and a recess 52 to engage the engaging piece 42 of the frame 4. Numeral 6 indicates an elongate collector which is formed on the insulating substrate 5 by printing and baking a conductive material such as silver paste. Numeral 7 indicates a resistor which is disposed in parallel with the collector 6. The external lead terminals 8 are fastened to the insulating substrate 5 by caulking or the like.

In the slide rheostat of the above construction, as seen from FIG. 2, the frame 4 is received in the case 1, and the upper surface portion 45 of the frame 4 is arranged so as to shield the collector 6 and the resistor 7 from the slot 14. The lever 22 of the slider carrier 2 protrudes through the slot 14, the slider carrier 2 slides on the shoulder portion 44 of the frame 4, and the slider 3 fastened to the mounting portion 24 underlying the upper surface portion 45 slides in contact with the collector 6 and the resistor 7.

As described above, the collector 6 and the resistor 7, which are portions to be energized, are shielded from the slot 14 of the case 1. Therefore, the portions to be energized are protected from the ill-disposed throwing of a coil or from dust.

When the rheostat of the present invention is to be installed on a mounting plate made of an insulating material, a metal material or the like, the situation is as illustrated in FIGS. 3(A) and 3(B). A substantially rectangular hole 91 which is slightly larger than the outside dimensions of the rheostat of the present invention is formed in the mounting plate 9. The case 1 is inserted into the hole 91. Then, the resilient engaging pieces 46 which are formed outside the end surface portions 43 of the frame 4 are snapped in and engaged with indents 92 which are formed at the end parts of the hole 91. The rheostat is also held on the mounting plate 9 by the engaging lugs 17 of the case 1.

In assembling the rheostat of the present invention, the indents 18 formed in the end surface portions 13 of the case 1 come into engagement with the step portions 47 of the elastic engaging pieces 46 of the frame 4, while the indent 15 formed in the side surface portion 12 of the case 1 comes into engagement with the engaging piece 42 formed on the side surface portion 41 of the frame 4. Therefore, the frame 4 is reliably received and fastened in the case 1.

As set forth above, the slide rheostat of the present invention can very simply construct the electrically-insulating and dust-proof structure for safety and protection measures, and it can be readily installed on the mounting plate by the snap-in method. These features are greatly effective in practical use.

I claim:

1. A slide rheostat comprising a case having a longitudinal slot formed in its upper surface; an insulating substrate held to the lower portion of said case and carrying an elongate resistor and an elongate collector; an insulating slider carrier having a lever portion extending through said slot and carrying a conductive slider adapted to slide in contact along said elongate resistor and said elongate collector by movement of said lever portion along said slot; and means including an insulating frame located within said case for supporting said slider carrier while providing an upper surface underlying said slot and being sufficiently larger in length and width than said slot for reducing the amount of dust and the like which may enter the interior of said resistor through said slot.

2. A slide rheostat according to claim 4, said slide carrier having a leg portion riding on said substrate and extending upwardly along a side of said case, a top wall portion held at one side to said leg portion and extending transversely across said slot to a free side, said frame including a side wall extending upwardly along the other side of said case and having a raised shoulder on its upper surface for supporting said free side of said carrier slider.

3. A slide rheostat according to either claim 4 or 5, said frame having respective end portions each having a resilient engaging piece inclinning slightly outward and adapted to hold said frame to a mounting plate.

* * * * *